US009761992B2

(12) United States Patent
Hashimoto et al.

(10) Patent No.: US 9,761,992 B2
(45) Date of Patent: Sep. 12, 2017

(54) CONNECTOR

(71) Applicant: Sumitomo Wiring Systems, Ltd., Yokkaichi, Mie (JP)

(72) Inventors: Norihito Hashimoto, Mie (JP); Shinya Morimoto, Mie (JP); Takeshi Tsuji, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/202,618

(22) Filed: Jul. 6, 2016

(65) Prior Publication Data

US 2017/0033494 A1 Feb. 2, 2017

(30) Foreign Application Priority Data

Jul. 30, 2015 (JP) ..... 2015-150685

(51) Int. Cl.
*H01R 13/52* (2006.01)
*H01R 13/64* (2006.01)
*H01R 13/641* (2006.01)

(52) U.S. Cl.
CPC ..... *H01R 13/5219* (2013.01); *H01R 13/64* (2013.01); *H01R 13/641* (2013.01)

(58) Field of Classification Search
CPC ..... H01R 13/5219; H01R 13/64
USPC ..... 439/272
See application file for complete search history.

(56) References Cited

U.S. PATENT DOCUMENTS

| | | | | |
|---|---|---|---|---|
| 9,048,574 | B2 * | 6/2015 | Hiramatsu | H01R 13/6272 |
| 9,071,021 | B2 * | 6/2015 | Hiramatsu | H01R 13/6277 |
| D733,660 | S * | 7/2015 | Amano | D13/147 |
| 9,077,106 | B2 * | 7/2015 | Suzuki | H01R 13/6272 |
| 9,099,812 | B2 * | 8/2015 | Sugimoto | H01R 13/64 |
| 9,147,958 | B2 * | 9/2015 | Kuroda | H01R 13/4362 |
| 2014/0120762 | A1 * | 5/2014 | Kuroda | H01R 13/4223 439/370 |

FOREIGN PATENT DOCUMENTS

JP 2014-59960 4/2014

* cited by examiner

*Primary Examiner* — Abdullah Riyami
*Assistant Examiner* — Nader Alhawamdeh
(74) *Attorney, Agent, or Firm* — Gerald E. Hespos; Michael J. Porco; Matthew T. Hespos

(57) ABSTRACT

It is aimed to provide a connector capable of enhancing the reliability of rattling prevention. A front member (90) is mounted on a front surface side of a housing main body (11). The front member (90) includes a straight wall (41) configured to face an erroneous connection preventing surface (214) of a mating housing (200) when a housing (10) is in a proper connection posture with respect to the mating housing (200). A rattling preventing portion (45) projects on the straight wall (41) and is configured to suppress rattling between the two housings (10, 200) by contacting an inner surface of a receptacle (210) and a curved wall (99) arranged more outward than the rattling preventing portion (45) when viewed from front and configured to regulate forward detachment of a seal (70) with the front member (90) mounted on the housing main body (11).

2 Claims, 19 Drawing Sheets

CONNECTOR

BACKGROUND

1. Field of the Invention

The present invention relates to a connector.

2. Description of the Related Art

Japanese Unexamined Patent Publication No. 2014-59960 discloses a connector with a female housing and a male housing that are connectable to each other. The female housing has a terminal accommodating portion and a front retainer is mounted on a front surface side of the terminal accommodating portion of the female housing. Circumferentially spaced rattling preventing ribs are provided on the outer peripheral surface of the front retainer and extend in a front-back direction. Each rattling preventing rib contacts the inner peripheral surface of a small receptacle of the male housing to suppress rattling of the terminal accommodating portion in the small receptacle when the two housings are connected.

The rattling preventing ribs are exposed on the outer peripheral surface of the front retainer prior to assembling the components of the connector. Thus, foreign matter easily can contact the rattling preventing ribs from outside. The reliability of rattling prevention by the rattling preventing ribs may be impaired if the rattling preventing ribs are squeezed due to interference with a foreign matter.

The invention was completed based on the above situation and aims to provide a connector capable of enhancing the reliability of rattling prevention.

SUMMARY

The invention is directed to a connector with a housing main body configured so that a receptacle of a mating housing is fit externally on the housing main body from the front. A seal is fit on an outer peripheral surface of the housing main body and is sandwiched resiliently between the housing main body and the receptacle when the two housings are connected. A front member is mounted on a front surface side of the housing main body and is arranged inside the mating housing when the two housings are connected. The front member includes a straight wall configured to face an erroneous connection preventing surface of the mating housing when the housing is in a proper connection posture with respect to the mating housing. A rattling preventing portion projects on the straight wall and is configured to suppress rattling between the two housings by contacting an inner surface of the receptacle. A curved wall is arranged more outward than the rattling preventing portion when viewed from the front and is configured to regulate forward detachment of the seal with the front member mounted on the housing main body.

Although the rattling preventing portion projects on the straight wall, the curved wall is arranged more outward than the rattling preventing portion when viewed from the front. Thus, foreign matter cannot contact the rattling preventing portion from the outside. As a result, a projecting shape of the rattling preventing portion is maintained and the reliability of rattling prevention by the rattling preventing portion can be enhanced.

The curved wall protects the rattling preventing portion and also regulates detachment of the seal, thereby simplifying the entire configuration of the front member.

The rattling preventing portion is arranged at a position overlapping an outermost end of the curved wall in a height direction when viewed from the front. According to this configuration, foreign matter is less likely to interfere with the rattling preventing portion from outside since the rattling preventing portion is at a distance from the outermost end of the curved wall.

DETAILED DESCRIPTION

Figure 1:
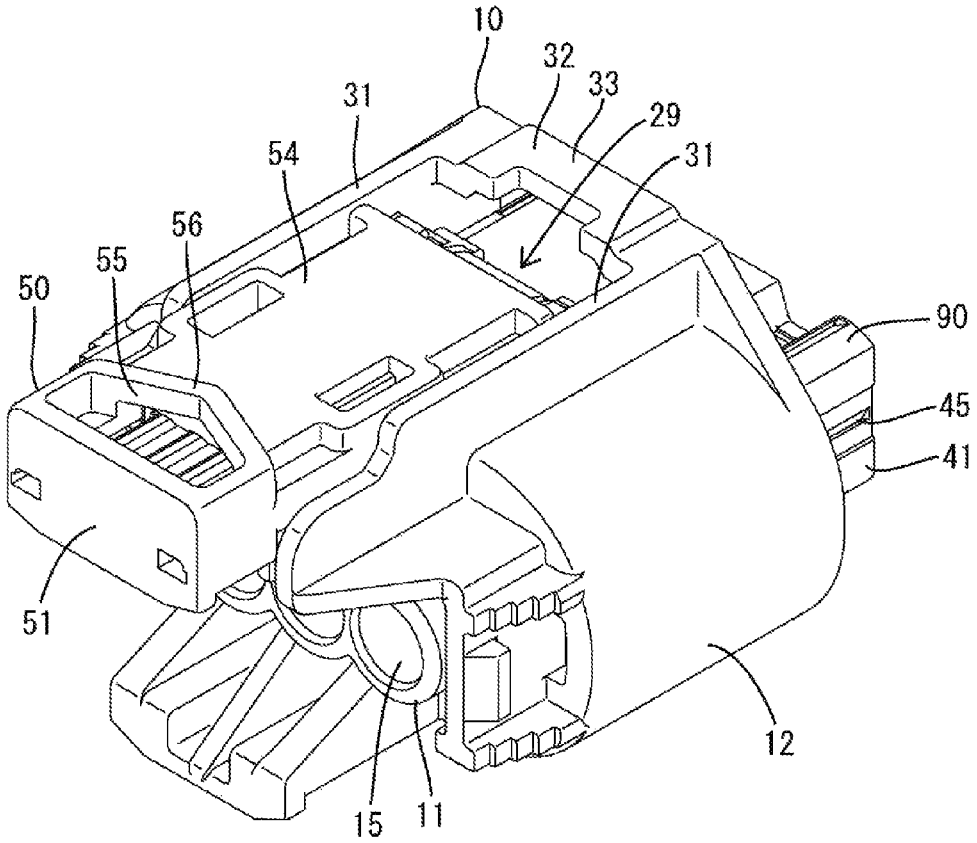
FIG. 1 is a perspective view when a connector of an embodiment of the present invention is viewed obliquely from an upper rear side.

An embodiment of the invention is described below with reference to the drawings. A connector of this embodiment includes a housing 10 connectable to a mating housing 200. A detector 50 is assembled with the housing 10 and is movable between a standby position and a detection position. A seal 70 is mounted into the housing 10 and provides sealing between the housing 10 and the mating housing 200. A front member 90 is mounted on a front end part of the housing 10.

Figure 19:
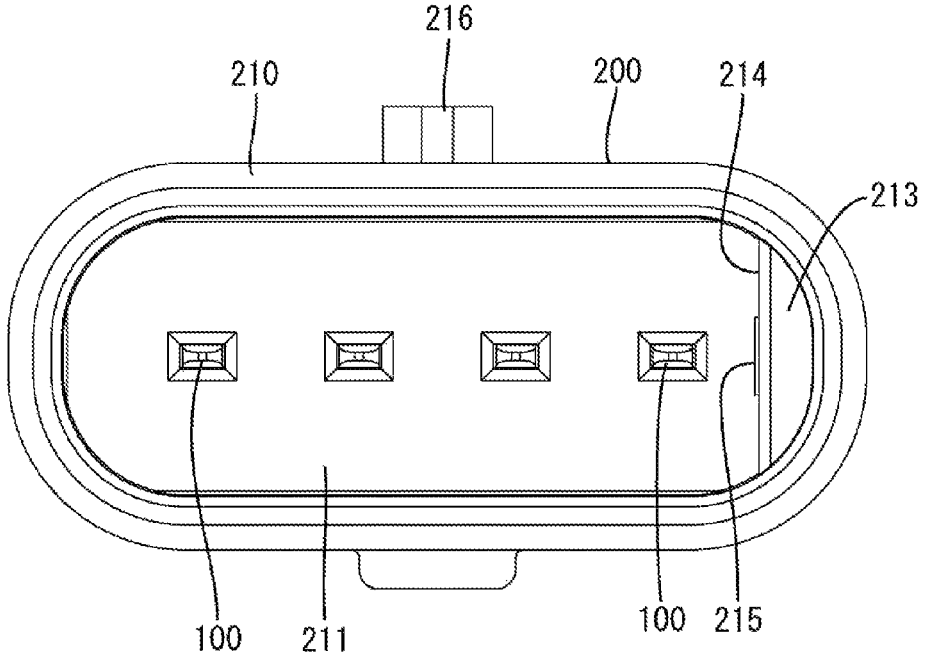
FIG. 19 is a front view of a mating housing.
Figure 20:
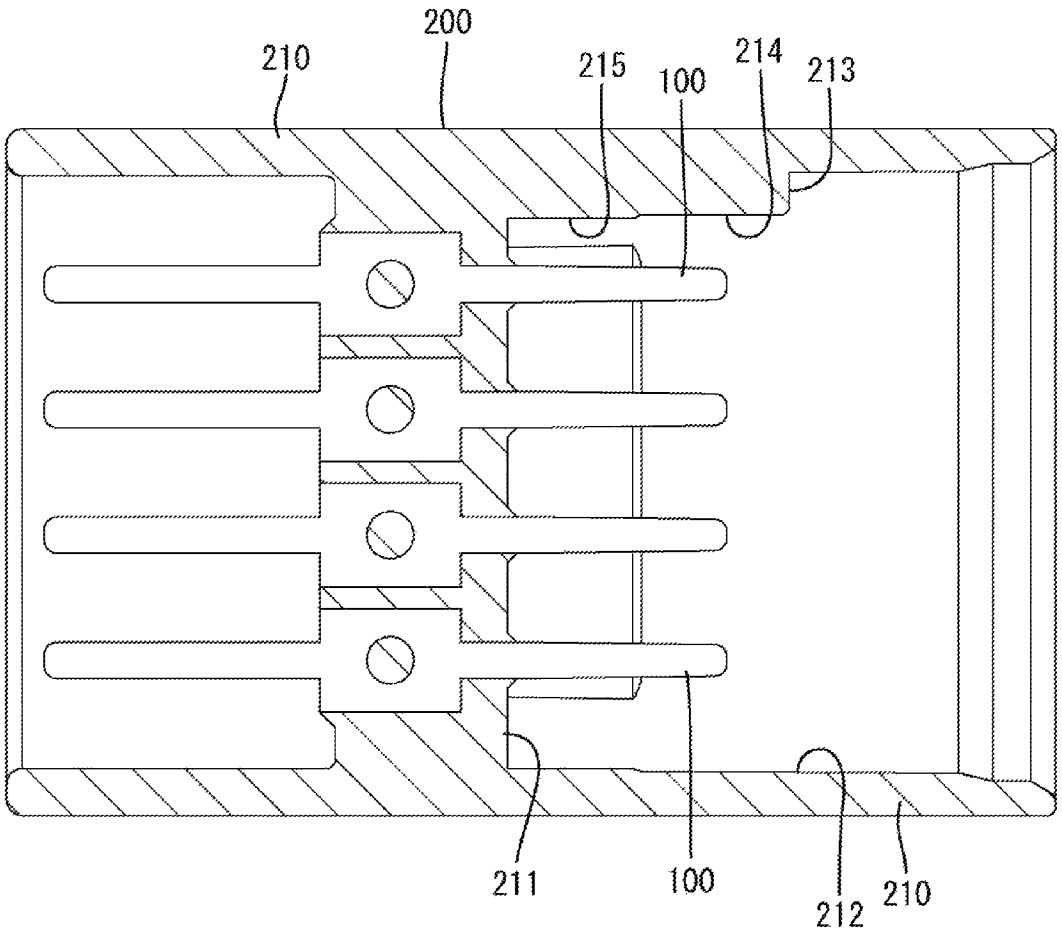
FIG. 20 is a section of the mating housing.

The mating housing 200 is made of synthetic resin and includes a tubular receptacle 210 that is flat in a width direction, as shown in FIG. 19. A separation wall 211 divides the interior of the receptacle 210 into front and rear parts, as shown in FIG. 20, and male terminal fittings 100 are mounted side by side in a row in the width direction on the separation wall 211. Each male terminal fitting 100 is made of electrically conductive metal and extends straight in the front-back direction.

As shown in FIG. 20, a fitting 212 is located in the receptacle 210 before the separation wall 211 and fits into a later-described connection space 14 of the housing 10. A step 213 is provided at an intermediate position in the front-back direction on one side surface of the inner periphery of the fitting 212, as shown in FIGS. 19 and 20. The step 213 increases the thickness of rear areas of the wall of the fitting 212. The inner surface of the rear area of the fitting 212 defines an erroneous connection preventing surface 214 extending along a vertical direction and the front-back direction. A protrusion 215 projects in a vertical central part of a rear area of the erroneous connection preventing surface 214 of the fitting 212 and is rectangular in a side view (not shown) while having a flat trapezoidal shape as viewed from the front. Further, a lock 216 projects on the upper surface of a front part of the fitting 212, as shown in FIGS. 6 and 19.

Figure 7:
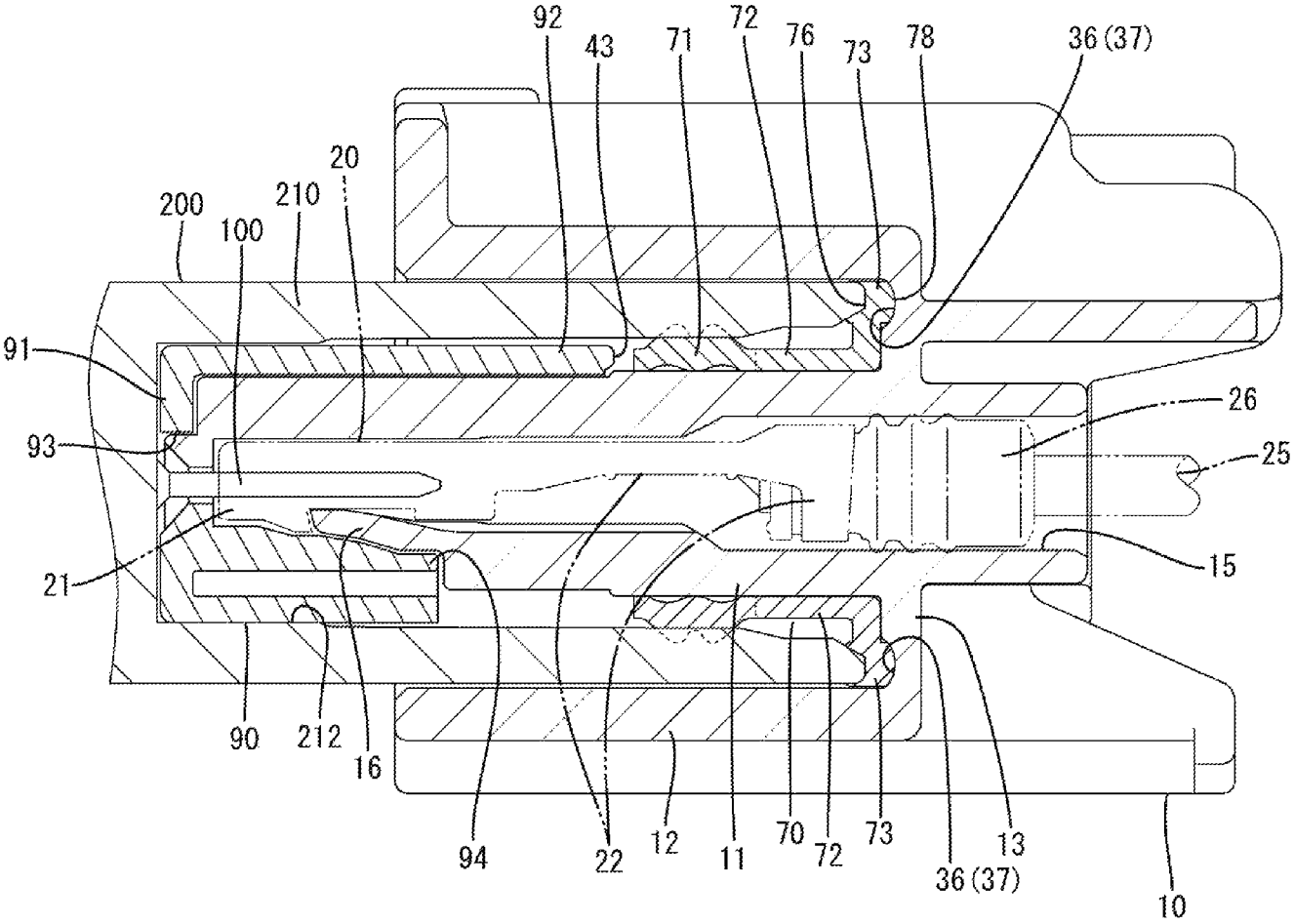
FIG. 7 is a section showing a state where protruding pieces are sandwiched resiliently between a receptacle and a coupling portion.
Figure 8:
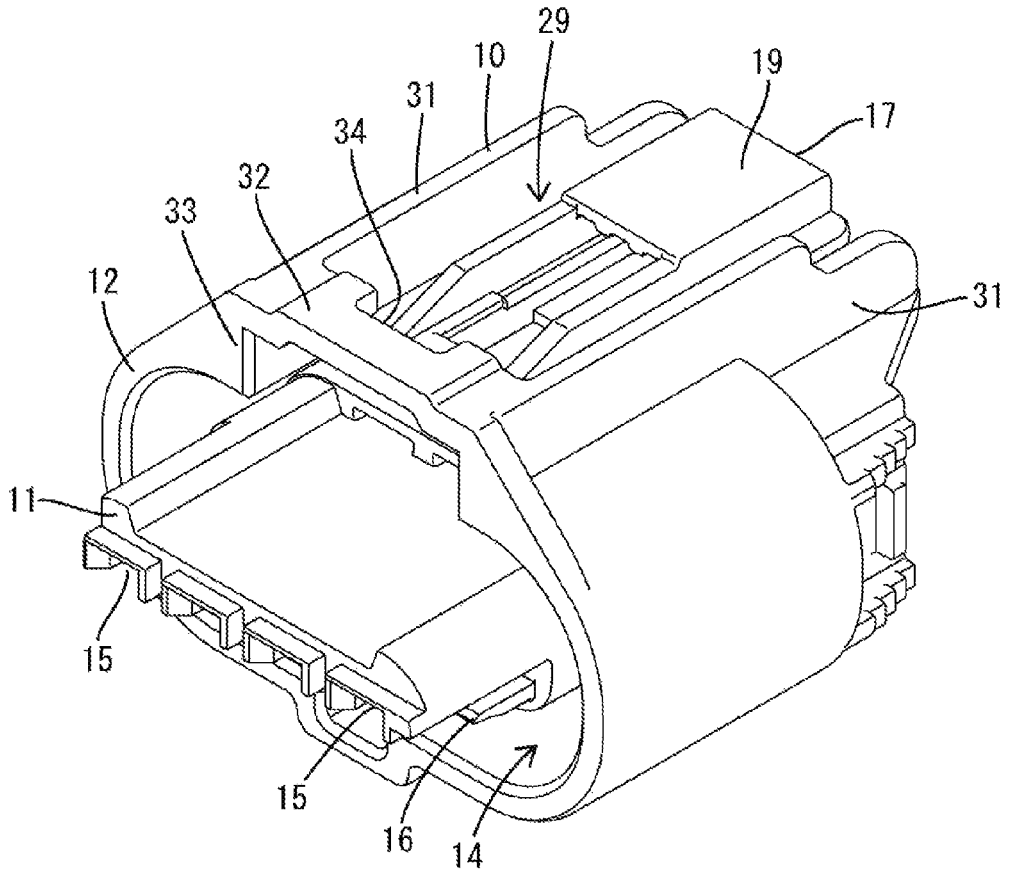
FIG. 8 is a perspective view when a housing is viewed obliquely from an upper front side.
Figure 9:
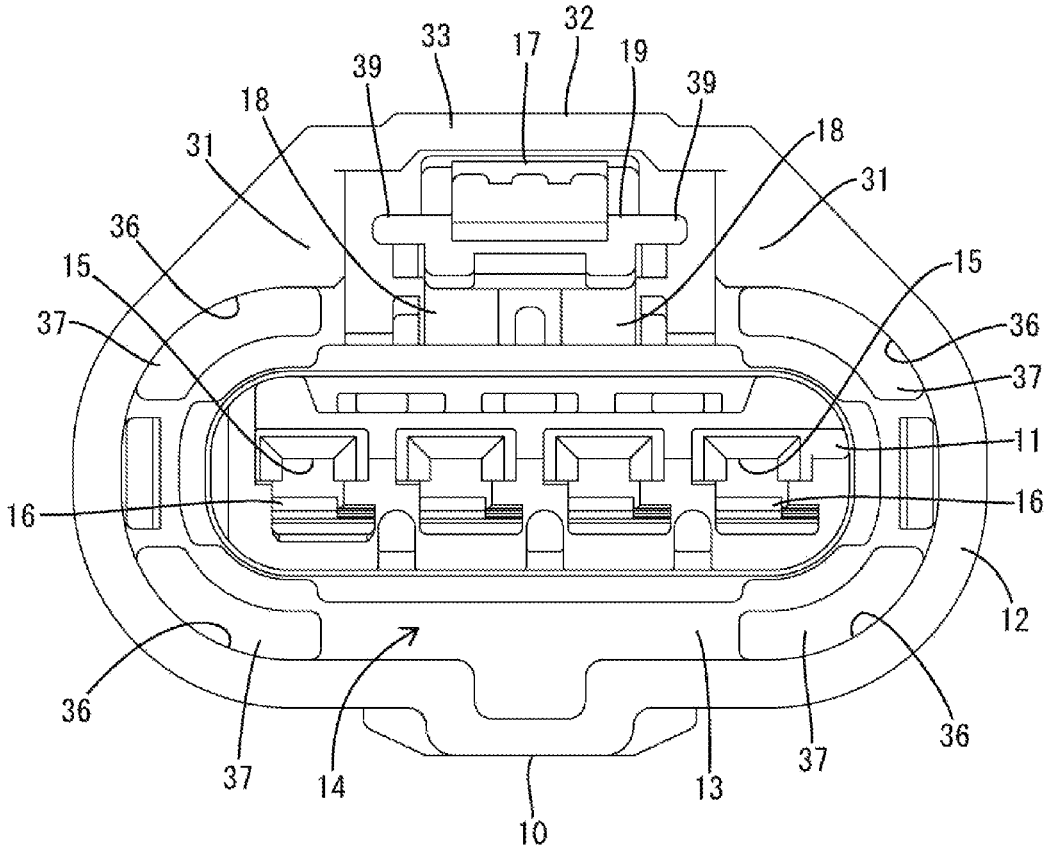
FIG. 9 is a front view of the housing.

The housing 10 is made unitarily of synthetic resin and, as shown in FIGS. 7 to 9, includes a housing main body 11 in the form of a flat block extending in the lateral direction of FIG. 9. A fitting tube 12 surrounds the outer periphery of the housing main body 11 and a radially extending coupling 13 couples the fitting tube 12 and the housing main body 11. A space between the housing main body 11 and the fitting tube 12 and before the coupling 13 is open as the connection space 14. Cavities 15 extend in the front-back direction through the housing main body 11 and are provided side by side in a row in the width direction. A deflectable locking lance 16 projects at the lower surface of an inner wall of each cavity 15. As shown in FIG. 7, a female terminal fitting 20 is inserted into the cavity 15 from behind.

The female terminal fitting 20 is made of electrically conductive metal and is long and narrow in the front-back direction. The female terminal fitting 20 has a tubular connecting portion 21 in a front part and an open barrel 22 in a rear part, as shown in FIG. 7. A male terminal fitting 100 mounted in the mating housing 200 is inserted into the connecting portion 21 from the front and connects to the female terminal fitting 20 when the two housings 10, 200 are connected properly. The barrel 22 is crimped and connected to an end part of a wire 25 and a rubber plug 26 is fit externally on an outer peripheral surface of the wire 25. The locking lance 16 locks the connecting portion 21 when the female terminal fitting 20 is inserted properly into the cavity 15, thereby retaining the female terminal fitting 20 in the cavity 15 with the rubber plug 26 inserted in a liquid-tight manner into a rear end part of the cavity 15.

Figure 4:
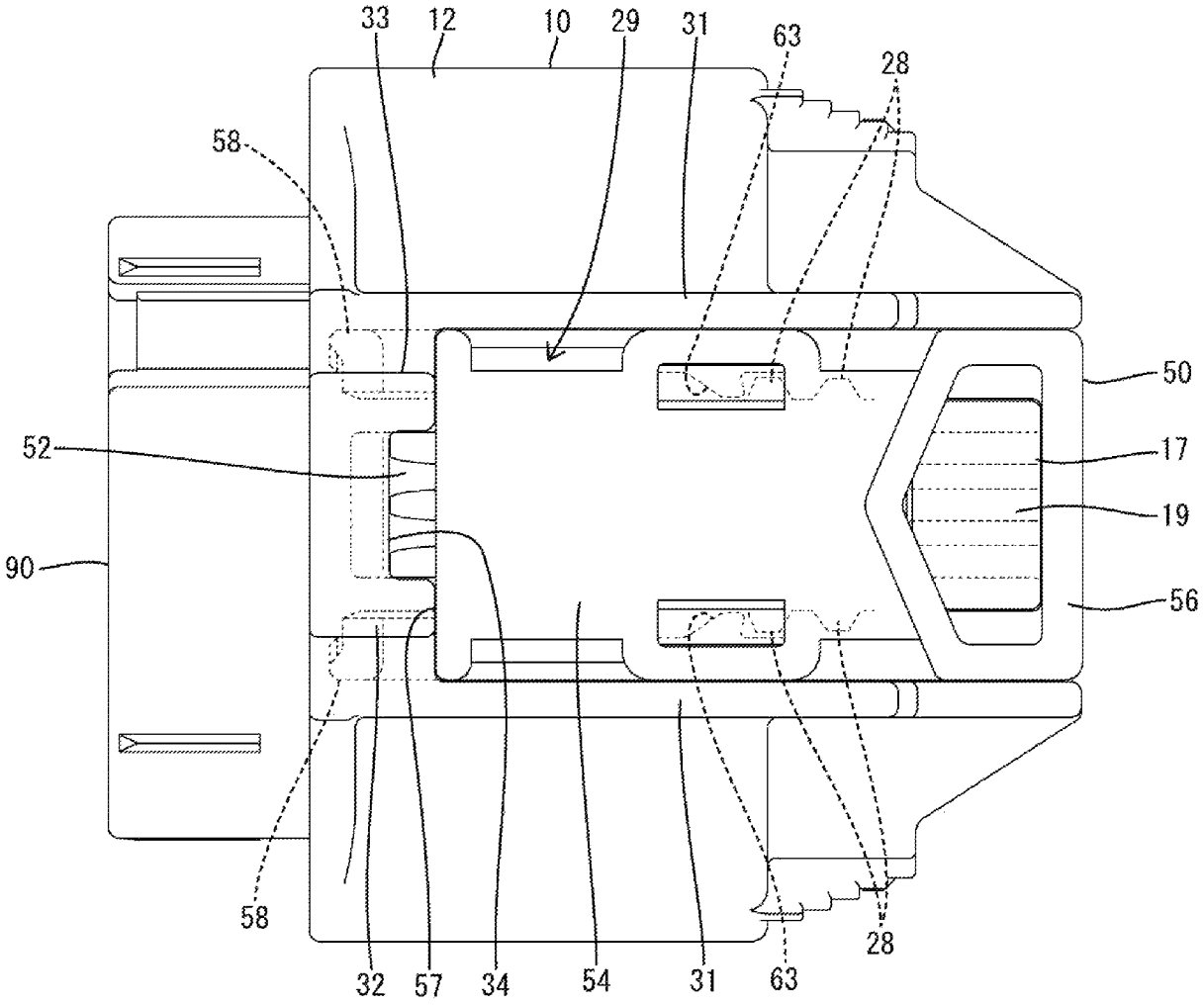
FIG. 4 is a plan view of the connector in which the detector is kept at the detection position.
Figure 6:
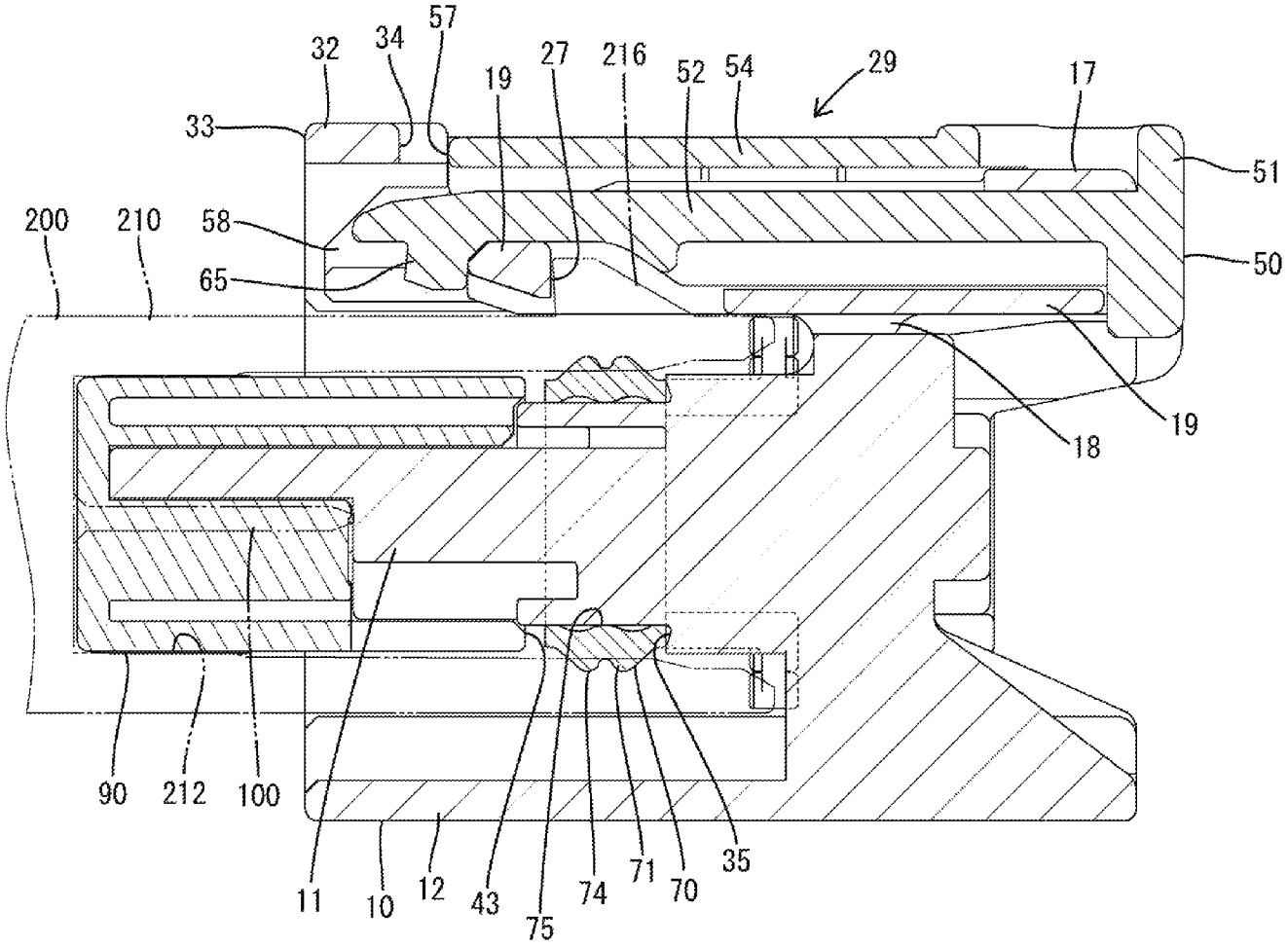
FIG. 6 is a section of the connector showing the detector kept at the detection position.

A deflectable lock arm 17 is provided above the housing main body 11, as shown in FIGS. 6 and 9. The lock arm 17 has legs 18 standing up from the upper surface of the housing main body 11 and an arm main body 19 extends forward and back from the upper ends of the legs 18. The arm main body 19 is a flat plate extending along the front-back direction and is inclinable and resiliently displaceable in the vertical direction with the upper ends of the legs 18 as supports. As shown in FIG. 6, a lock hole 27 vertically penetrates a front part of the arm main body 19. When the two housings 10, 200 are connected properly, the lock 216 is fit resiliently into the lock hole 27 of the arm main body 19 so that the two housings 10, 200 are held together. Further, as shown in FIG. 4, retention receiving portions 28 project on opposite widthwise sides of the arm main body 19 and can lock to later-described retaining portions 63 of the detector 50.

As shown in FIG. 8, an open space 29 is open on an upper part of the fitting tube 12 and exposes the lock arm 17 upwardly before the detector 50 is assembled. Further, two protection walls 31 stand at opposite widthwise sides of the open space 29 on the top of the fitting tube 12, and a bridging wall 32 bridges between upper edges of front end parts of the protection walls 31. Front parts of the protection walls 31 and the bridging wall 32 form a bridge 33 that is U-shaped in a front view and defines the open space 29. A substantially rectangular cut portion 34 is provided on the rear end edge of the bridge 33 and a tip part of a detection arm 52 to be described later can be confirmed visually through the cut portion 24 when the detector 50 reaches the detection position.

As shown in FIG. 6, a step 35 is provided before the coupling 13 on the outer peripheral surface of the housing main body 11. The step 35 is configured so that the front area is narrower than the rear area. The seal 70 is fit in the front area of the outer peripheral surface of the housing main body 11.

Figure 14:
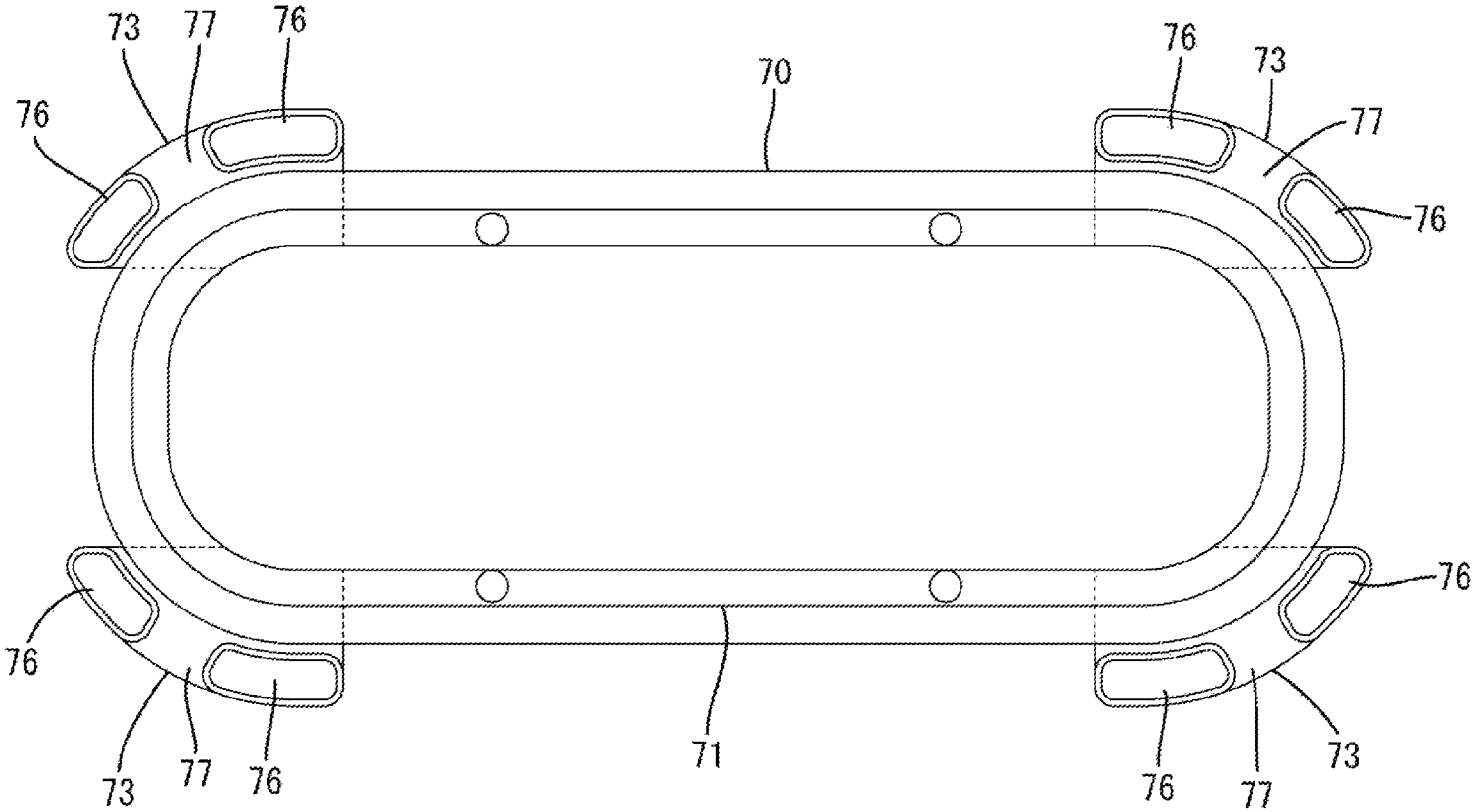
FIG. 14 is a front view of a seal.
Figure 15:
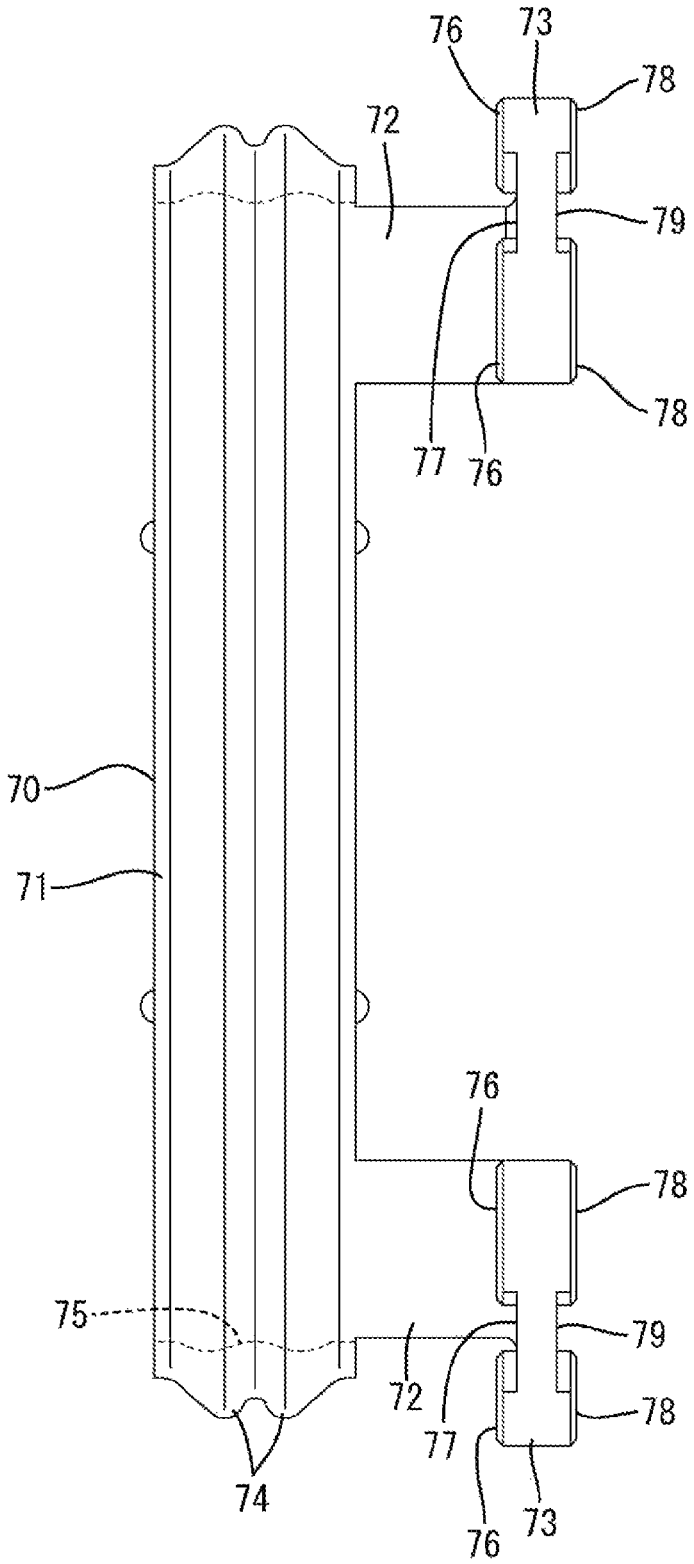
FIG. 15 is a plan view of the seal.

The seal 70 is made of rubber, such as silicon rubber and, as shown in FIGS. 14 and 15, is formed integrally to include a seal main body 71, strips 72 and protrusions 73. The seal main body 71 is a substantially rectangular ring that is long in the width direction when viewed from the front and has four curved corners. The strips 72 are long and narrow and extend straight back from the corners on the rear of the seal main body 71. The protrusions 73 protrude out from the rear ends of the strips 72. As shown in FIG. 14, the outer peripheral edge of the protrusion 73 is curved into a substantially arcuate shape to extend along the corner part of the seal main body 71 in a front view.

As shown in FIGS. 6 and 15, outer peripheral lips 74 are provided circumferentially on the outer peripheral surface of the seal main body 71 and an inner peripheral lip 75 is provided circumferentially on the inner peripheral surface thereof. When the seal 70 is fit onto the housing main body 11, the inner lip 75 is held resiliently in close contact with the outer peripheral surface of the housing main body 11. Further, when the two housings 10, 200 are connected properly, the outer peripheral lips 74 are held resiliently in close contact with the inner peripheral surface of the receptacle 210 inserted into the connection space 14. In this way, liquid-tight sealing is provided between the two housings 10, 200 via the seal main body 71.

As shown in FIG. 14, pressure receiving portions project on the front surface of the protrusion 73 and are divided in the width direction via a groove 77. Further, as shown in FIG. 15, two protrusions 78 project on the rear surface of the protrusion 73 at positions back-to-back with the pressure receiving portions 76 and are divided in the width direction via a groove 79. As shown in FIG. 15, the front end surfaces of the pressure receiving portions 76 and the rear end surfaces of the protrusions 78 are arranged along the width direction. As shown in FIG. 7, when the two housings 10, 200 are connected properly, the protrusions 73 are sandwiched in the front-back direction between the receptacle 210 and the coupling 13, opening ends of four corners of the receptacle 210 are pressed into contact with the front end surfaces of the respective pressure receiving portions 76 and curved surfaces 37 of later-described recesses 36 of the coupling 13 are held in close contact with the rear end surfaces of the respective protrusions 78. Thus, the rattling of the two housings 10, 200 in the front-back direction is suppressed. In this case, the pressure receiving portions 76 and the protrusions 78 are compressively deformable toward the grooves 77, 79.

The front surface of the coupling 13 forms the back surface of the connection space 14 and extends in the circumferential direction except at parts corresponding to the legs 18 of the lock arm 17 with respect to the circumferential direction, as shown in FIG. 9. The recesses 36 are provided in back corner parts corresponding to the four corners of the receptacle 210 on the front surface of the coupling 13. The recess 36 is curved in the circumferential direction and, as shown in FIG. 7, the inner surface thereof is formed as the curved surface 37 concavely curved in a depth direction from the opening end to the back end. The opening end of the curved surface 37 of the recess 36 is chamfered arcuately and widened toward the front. The corresponding protrusion 78 is inserted in a positioned state into the recess 36. At this time, the protrusion 78 is guided from the opening end toward the back end of the recess 36 along the curved surface 37 of the recess 36.

The front member 90 is mounted on the front of the housing main body 11. The front member 90 is made of synthetic resin in the shape of a cap and, as shown in FIGS. 6 and 7, is arranged inside the fitting 212 of the receptacle 210 when the two housings 10, 200 are connected properly. Specifically, as shown in FIGS. 10 to 13, the front member 90 is formed integrally of a wide plate-shaped front wall 91 and a tubular peripheral wall 92 extending back from the outer peripheral edge of the front wall 91.

Figure 10:
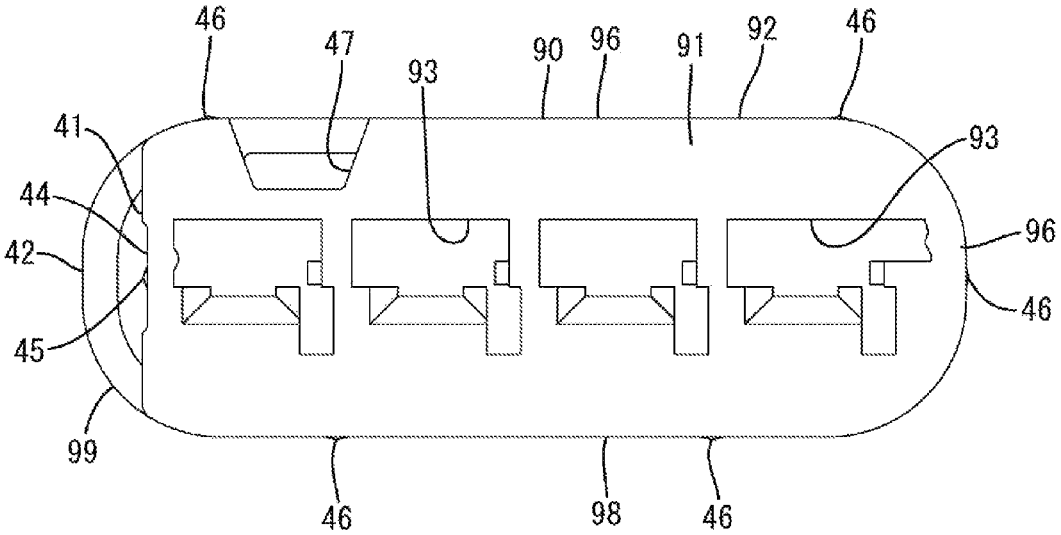
FIG. 10 is a front view of a front member.

The front wall 91 has a plurality of through holes 93 arranged side by side in a row in the width direction at positions corresponding to the respective cavities 15, as shown in FIG. 10. As shown in FIG. 7, the rear surface of the front wall 91 is provided with retaining pieces 94 projecting backwardly from lower edge parts of the through holes 93.

As shown in FIG. 10, the peripheral wall 92 is formed integrally to include an upper wall 96, a side wall 97, a lower wall 98, a curved wall 99 and a straight wall 41. The upper and lower walls 96, 98 have parts arranged substantially parallel to each other along the width direction. Upper and lower ends of the straight wall 41 and the curved wall 99 are coupled integrally at one slightly curved widthwise end of the upper and lower walls 96, 98, while upper and lower ends of the side wall 97 are coupled integrally to the other widthwise end of the upper and lower walls 96, 98.

The side wall 97 is formed over the entire length of the peripheral wall 92 in the front-back direction and is curved arcuately laterally out (toward the right side of FIG. 10) in a front view. The curved wall 99 is arranged substantially symmetrically with the side wall 97 in the width direction on a rear end part of the peripheral wall 92 and is curved arcuately laterally out (toward the left side of FIG. 10) in a front view. As shown in FIG. 10, the curved wall 99 is bridged in an arched manner between the one widthwise ends of the upper and lower walls 96, 98. An outermost end portion 42 protruding most outward is provided substantially along the vertical direction in a vertical central part of the curved wall 99.

A rear end of the upper wall 96, a rear end of the side wall 97, a rear end of the lower wall 98 and the curved wall 99 form a ring shape continuously over the entire circumference, and defines a pressing portion 43 for regulating forward detachment of the seal 70 by facing the seal 70 when the front member 90 is mounted properly on the housing 10 as shown in FIGS. 6 and 7.

As shown in FIGS. 10 to 13, the straight wall 41 is arranged before the curved wall 99 on one widthwise end of the peripheral wall 92. The outer surface of the straight wall 41 extends vertically and in the front-back direction and faces the erroneous connection preventing surface 214 of the mating housing 200 when the two housings 10, 20 are connected properly.

Figure 13:
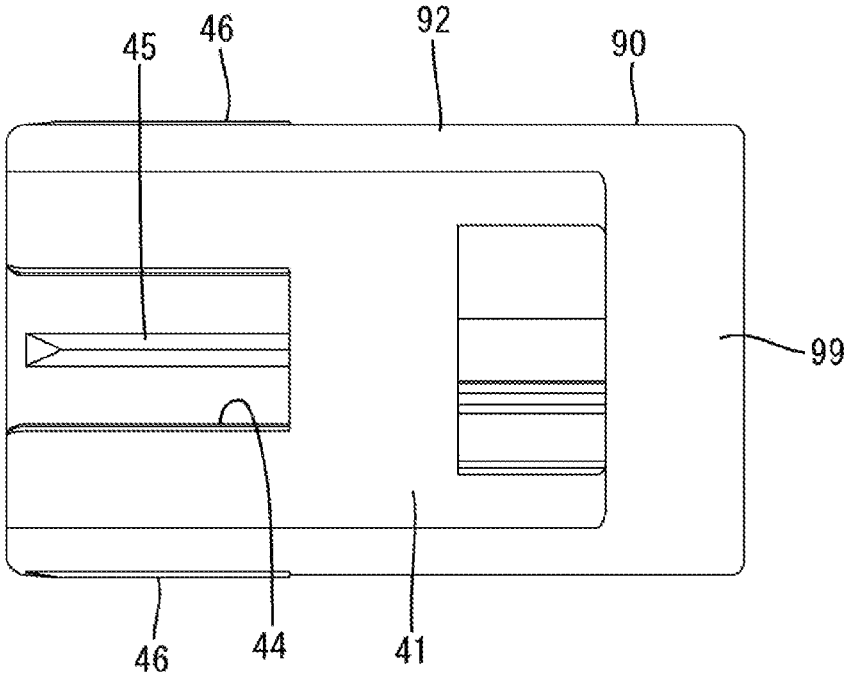
FIG. 13 is a side view of the front member.

As shown in FIGS. 10 and 13, a shallow recess 44 is provided on the outer surface of the straight wall 41 and is provided in a predetermined range extending back from the front end of the front member 90. The recess 44 defines a rectangle that is long in the front-back direction when viewed from the side, as shown in FIG. 13. A rattling preventing rib 45 projects on the back surface of the recess 44 and extends in the front-back direction at a vertical central part of the straight wall 41 (also a vertical central part of the front member 90). The protruding portion 215 can fit into the recess 44. When the front member 90 is viewed from the front, the curved wall 99 protrudes laterally out beyond the rattling preventing rib 45 (left in FIG. 10). Further, the rattling preventing rib 45 is at a position overlapping with the outermost end 42 of the curved wall 99 in the vertical direction. Thus, foreign matter from a lateral side comes into contact with the outermost end 42 of the curved wall 99 so that no foreign matter contacts the rattling preventing rib 45.

Figure 11:
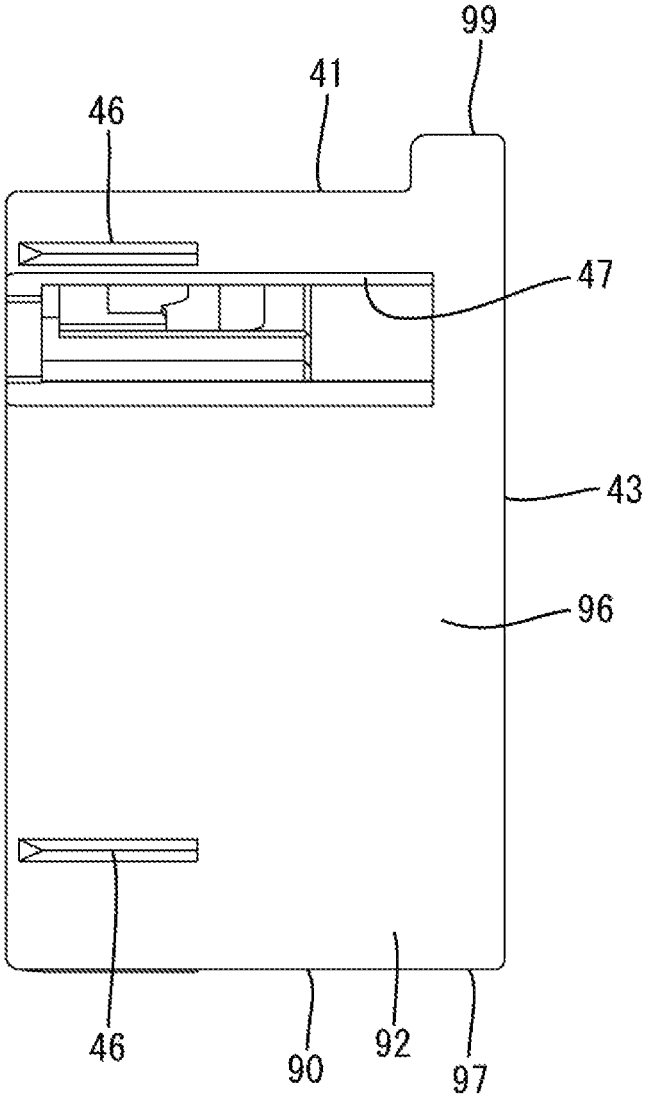
FIG. 11 is a plan view of the front member.
Figure 12:
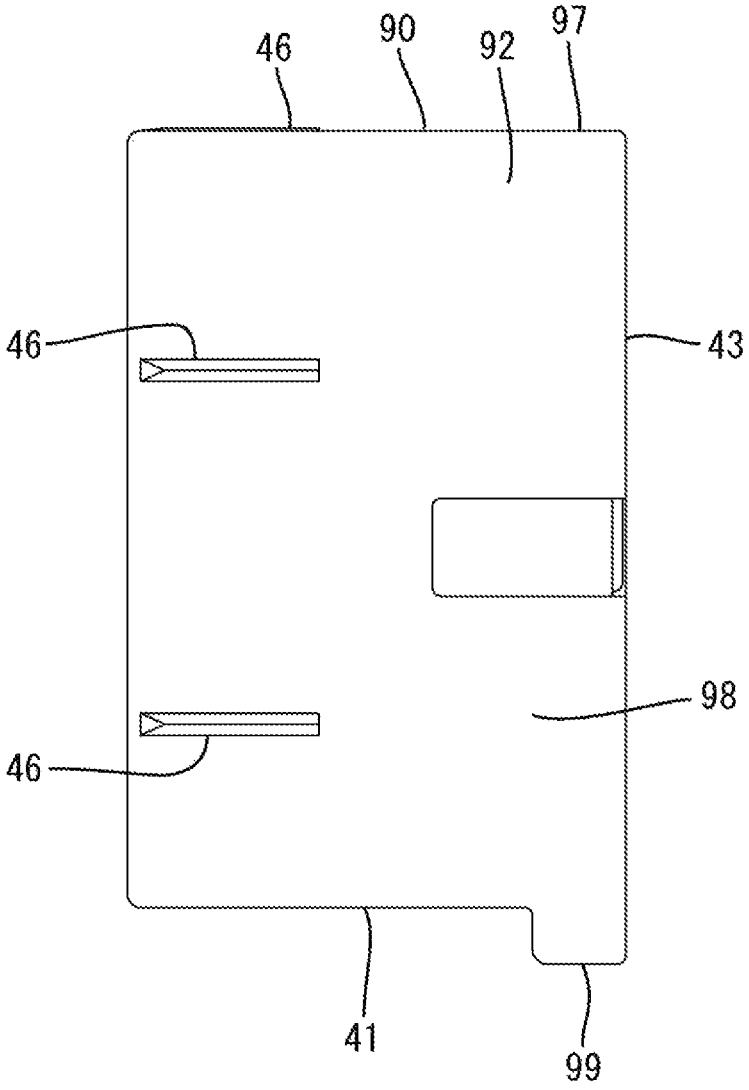
FIG. 12 is a bottom view of the front member.

As shown in FIG. 10, ribs 46 project on the outer peripheral surface of the peripheral wall 92 while being spaced apart in the circumferential direction. As shown in FIGS. 11 and 12, each rib 46 extends in the front-back direction, with the front end thereof located on the front of the peripheral wall 92 and the rear end is slightly before a center of the peripheral wall 92 in the front-back direction. Each rib 46 is formed to have substantially the same shape as the rattling preventing portion 45. As shown in FIG. 10, the ribs 46 are arranged on opposite widthwise ends of the outer surface of the upper wall 96, opposite widthwise ends of the outer surface of the lower wall 98 and a vertical central part of the outer surface of the side wall 97. The rib 46 on the vertical central part of the outer surface of the side wall 97 is at substantially the same height as the rattling preventing portion 45. Further, as shown in FIGS. 10 and 11, the one widthwise end part of the upper wall 96 is provided with a cut groove 47 extending in the front-back direction and open on the front wall 91.

The detector 50 is made of synthetic resin and is arranged above the housing main body 11 and between the protection walls 31 (see FIG. 1). The detector 50 is movable while sliding along the arm main body 19 of the lock arm 17. In this case, the detector 50 is movable by being pushed forward from the standby position to the detection position.

Figure 16:
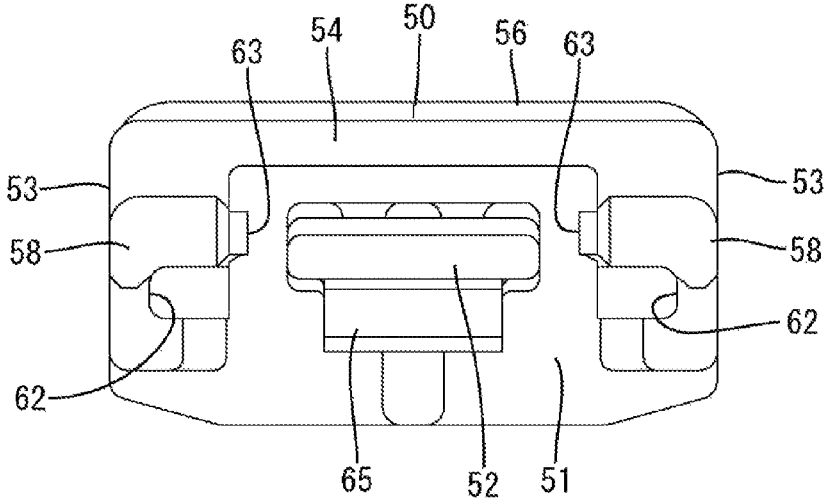
FIG. 16 is a front view of the detector.
Figure 17:
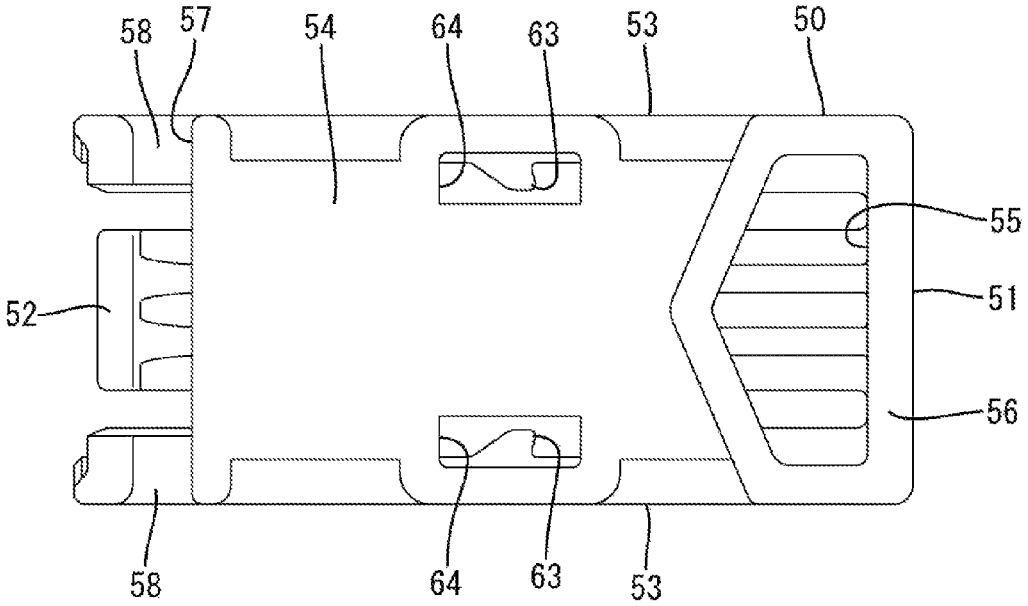
FIG. 17 is a plan view of the detector.

As shown in FIGS. 16 and 17, the detector 50 has a flat rectangular shape in a front view and includes a back plate 51 extending along the vertical direction, the long detection arm 52 extending forward from a widthwise central part of the back plate 51, two long projecting pieces 53 extending forward from opposite widthwise ends of the back plate 51 and a ceiling plate 54 bridged between the upper ends of both projecting pieces 53.

As shown in FIGS. 1 and 17, a window 55 vertically s through a rear end part of the ceiling plate 54. When the detector 50 is at the standby position, a rear end part of the detection arm 52 can be confirmed visually through the window 55 (see FIG. 3). When the detector 50 is at the detection position, a rear end part of the arm main body 19 of the lock arm 17 can be confirmed visually through the window 55 (see FIG. 4). Thus, whether the detector 50 is at the standby position or the detection position can be known through the window 55.

Further, a circling rib 56 circles around an opening edge of the window 55 on the outer surface of the rear end part of the ceiling plate 54, as shown in FIGS. 1 and 17. The front end of the ceiling plate 54 is arranged along the width direction, as shown in FIG. 4, and defines a contact portion 57 configured to contact the rear end of the bridge 33 when the detector 50 reaches the detection position.

Each projecting piece 53 is in the form of a strip extending along the vertical direction and the front-back direction. The rear ends of are coupled integrally to the back plate 51 and the upper ends thereof are coupled integrally to the ceiling plate 54 so that the projecting pieces 53 are not deflectable or deformable. As shown in FIG. 17, the front ends of the projecting pieces 53 are arranged at the foremost position in the entire detector 50.

Figure 2:
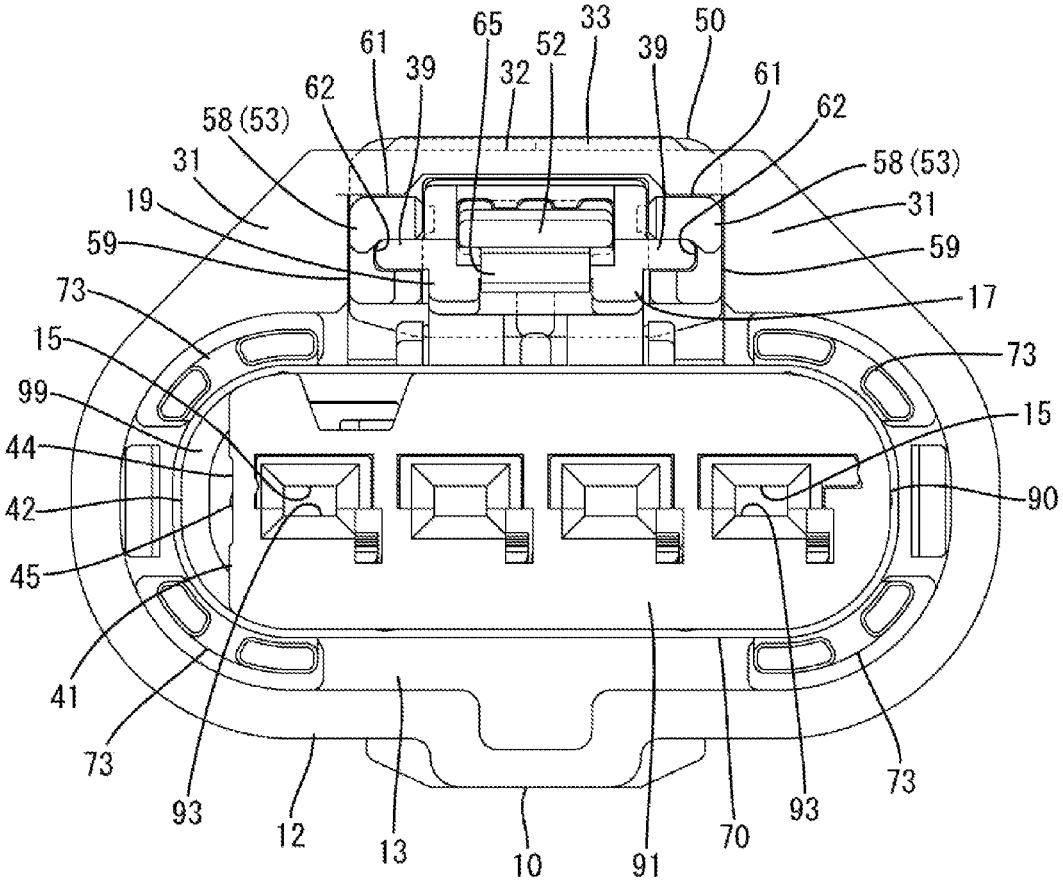
FIG. 2 is a front view of the connector in which a detector is kept at a detection position.

Front ends of the projecting pieces 53 project farther forward than the contact portion 57 of the ceiling plate 54, as shown in FIG. 17, and form entering portions 58 arranged to contact inner sides of opposite end corner parts (substantially L-shaped coupling parts coupled to the protection walls 31 and the bridging wall 32) of the bridge 33 when the detector 50 is at the detection position, as shown in FIGS. 2, 4, 5 and 6. As shown in FIG. 2, the entering portion 58 includes a side surface area 59 that can face and contact the inner surface of the protection wall 31 and an upper surface area 61 that is substantially perpendicular to the side surface area 59 and can face and contact the inner surface of the bridging wall 32.

As shown in FIG. 16, guide grooves 62 are recessed on the inner surfaces of the projecting pieces 53 and extend in the front-back direction. Guide ribs 39 protrude on opposite widthwise ends of the arm main body 19. The guide ribs 39 fit in and slide along the guide grooves 62 when the detector 50 moves to guide a sliding movement of the detector 50 (see FIG. 2).

Further, as shown in FIG. 17, claw-shaped retaining portions 63 project in substantially central parts of the inner surfaces of the projecting pieces 53 in the front-back direction. Two mold removal holes 64 are open on opposite widthwise sides of the ceiling plate 54 due to the passage of an unillustrated mold as the retaining portions 63 are formed.

Figure 18:
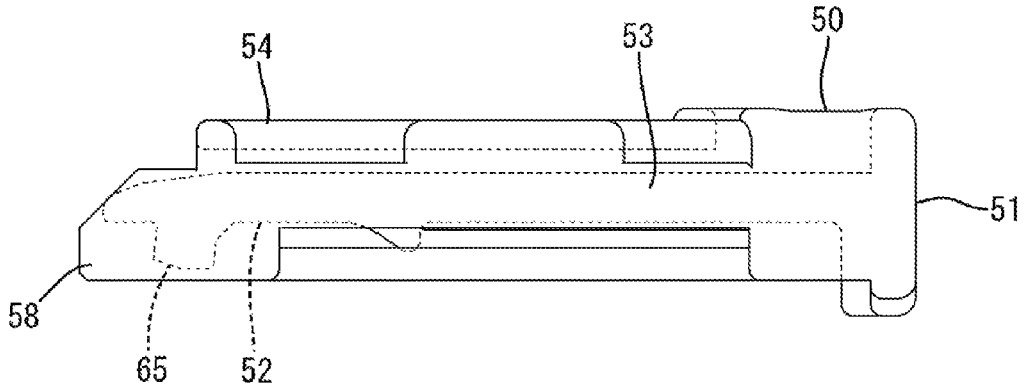
FIG. 18 is a side view of the detector.

The detection arm 52 is in the form of a strip extending along the width direction and the front-back direction and is vertically deflectable and deformable. As shown in FIG. 17, the front end of the detection arm 52 is located before the contact portion 57 of the ceiling plate 54 and slightly behind the front ends of the entering portions 58 of the projecting pieces 53. As shown in FIG. 18, the detection arm 52 is hidden behind the projecting piece 53 when the detector 50 is laterally viewed and is hardly seen.

A claw-shaped locking projection 65 projects on the lower surface of a front end part of the detection arm 52. As described later, the locking projection 65 enters the lock hole 27 of the arm main body 19 of the lock arm 17 when the detector 50 is at the standby position for locking the locking projection 65 to the arm main body 19.

During assembly, the seal 70 is mounted on the outer peripheral surface of the housing main body 11. More particularly, the front surfaces of the protrusions 73 are pushed by an unillustrated jig or the like and the protrusions 78 of the protrusions 73 slide on the curved surfaces 37 to be guided smoothly to the back sides of the recesses 36 and are accommodated in a positioned state in the recesses 36. In the process of mounting the seal 70, the protrusions 78 slide on the curved surfaces 37 to prevent the protrusions 73 and the strips 72 from being strained, deformed or the like. When the seal 70 is mounted properly onto the housing main body 11, the seal main body 71 is held resiliently in close contact with the outer peripheral surface of the housing main body 11 and the strips 72 are arranged to extend in the front-back direction along the outer peripheral surface of the housing main body 11 between the seal main body 71 and the protrusions 73 (see FIG. 7).

Subsequently, the front member 90 is mounted to a proper depth onto the front end part of the housing main body 11. Then, the retaining pieces 94 enter deflection spaces for the locking lances 16 to regulate the deflection of the locking lances 16. In this way, the female terminal fittings 20 inserted into the cavities 15 are locked doubly. Further, the pressing portion 43 of the front member 90 is arranged to face the front end of the seal main body 71, thereby regulating forward detachment of the seal 70.

Figure 3:
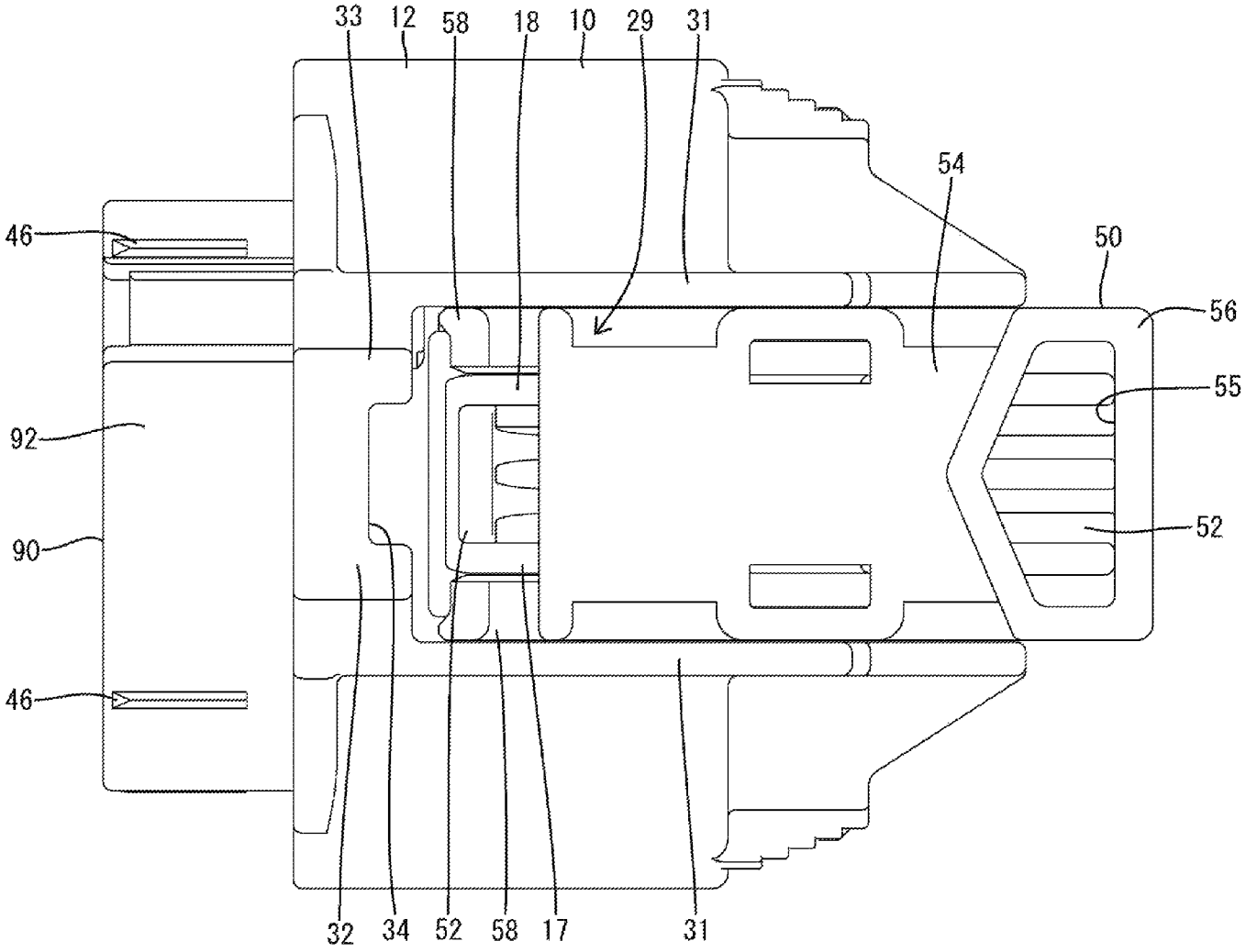
FIG. 3 is a plan view of the connector in which the detector is kept at a standby position.

In a stage before the two housings 10, 200 are connected, the detector 50 is kept at the standby position (see FIGS. 1 and 3). At the standby position, the ceiling plate 54 is arranged to cover the arm main body 19 of the lock arm 17 from above, the projecting pieces 53 are arranged to contact the inner sides of the protection walls 31 and the guide ribs 39 are fit to and inserted in the guide grooves 62 of the projecting pieces 53. At the standby position, the detection arm 52 is inserted into the lock hole 27 of the lock arm 17 from behind and the locking projection 65 contacts the front end of the lock hole 27 to regulate a movement of the detector 50 to the detection position, and the separation of the detector 50 from the housing 10 is regulated by the retaining portions 63 of the projecting pieces 53 resiliently locking the retention receiving portions 28 of the lock arm 17.

Subsequently, the fitting portion 212 of the receptacle 210 of the mating housing 200 is inserted into the connection space 14 of the housing 10 and a connecting operation of the two housings 10, 200 is started. In the process of connecting the two housings 10, 200, the front end of the arm main body 19 interferes with the lock 216 to deflect and deform the lock arm 17. At this time, the detection arm 52 is deflected and deformed together with the lock arm 17 and a locked state of the locking projection 65 and the arm main body 19 is maintained. When the two housings 10, 200 are connected properly, the lock arm 17 resiliently returns and the lock 216 is fitted into the lock hole 27 do that the two housings 10, 200 are held in a state where the separation thereof is regulated (see FIG. 6). As the lock portion 216 is fitted into the lock hole 27, the locking projection 65 is pressed by the lock portion 216 to release the locked state with the arm main body 19 and a movement of the detector 50 to the detection position is enabled.

Subsequently, fingers are hooked to the circling rib 56 of the ceiling plate 54 and, in that state, the detector 50 is pushed to the detection position. At this time, the guide ribs 39 slide in the guide grooves 62 so that the detector 50 moves smoothly. Further, the locking projection 65 slides on the upper surface of the front of the arm main body 19 to deflect the detection arm 52. When the detector 50 reaches the detection position, the detection arm 52 resiliently returns and the locking projection 65 contacts the front end of the arm main body 19. This regulates a returning movement of the detector 50 to the standby position (see FIG. 6). Further, at the detection position, the contact portion 57 of the ceiling plate 54 is stopped in contact with the bridging wall 32 of the bridge 33 to regulate a forward movement of the detector 50 (see FIG. 4).

Figure 5:
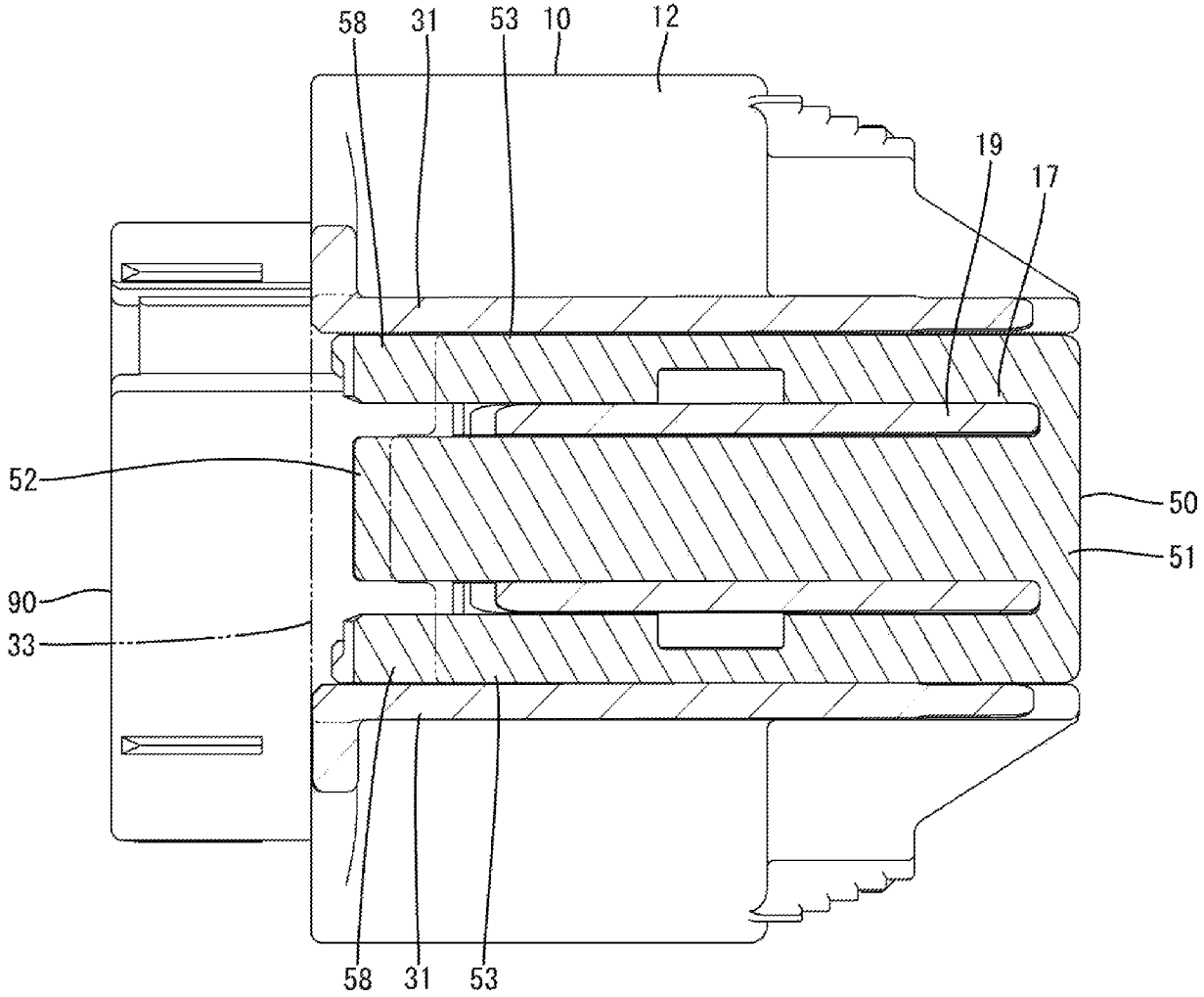
FIG. 5 is a plan view with a bridge of FIG. 4 shown in section.

Furthermore, from a stage before the detection position is reached to the detection position, the entering portions 58 of the projecting pieces 53 enter the bridge 33 and the side surface areas 59 and the upper surface areas 61 of the entering portions 58 are arranged to be able to contact the inner surfaces of the opposite end corners of the bridge 33 (see FIGS. 2 and 5). In this way, the opposite end corners of the bridge 33 are supported from an inner side and integrally made rigid, and the bridge 33 cannot deflected and deformed upon receiving an external force.

Further, when the two housings 10, 200 are properly connected, the opening end of the receptacle 210 comes into contact with the pressure receiving portions 76 of protrusions 78 and the protrusions 78 are pushed tightly to the back sides of the recesses 36 along the curved surfaces 37 while the pressure receiving portions 76 are squeezed (see FIG. 7). The protrusions 73 are compressed resiliently and deformed in the front-back direction in this way to suppress rattling between the two housings 10, 200 in the front-back direction.

The rattling preventing portion 45 and the ribs 46 contact the inner peripheral surface of the receptacle 210 from a final stage of the connecting process of the two housings 10, 200 to the proper connection, and projecting ends thereof are squeezed. In this case, the erroneous connection preventing surface 214 of the receptacle 210 face the straight wall 41 of the front member 90, the protruding portion 215 is fit in the recess 44 and, in that state, the rattling preventing portion 45 contacts the flat projecting end surface of the protruding portion 215 to be pressed and squeezed. Thus, the rattling of the housings 10, 200 in directions intersecting the connecting direction is suppressed by the rattling preventing portion 45 and the ribs 46.

On the other hand, if the housing 10 is not in a proper connection posture with respect to the mating housing 200, the connecting operation of the two housings 10, 200 is impeded due to the interference of the erroneous connection preventing surface 214 of the receptacle 210 with the front wall 91 of the front member 90. Thus, it can be known in an initial stage of the connection of the two housings 10, 200 that the two housings 10, 200 are not in proper connection postures.

As described above, the following effects can be exhibited according to this embodiment.

The curved surfaces 37 of the housing 10 guide the protrusions 78 of the protruding pieces 73 of the seal 70 to the backs of the recesses 36. Thus, the protruding pieces 73 and the strips 72 are prevented from being strained and deformed, and the rattling of the two housings 10, 200 can be suppressed reliably. More particularly, the long narrow strips 72 lack shape stability and the protrusions 78 are likely to be difficult to insert into the recesses 36. Thus, the structure for guiding the protrusions 78 along the curved surfaces 37 of the recesses 36 is important.

The entering portions 58 of the projecting pieces 53 of the detector 50 are arranged to contact the inner sides of the opposite ends of the bridge 33 so that external forces will not deform the bridge 33. As a result, the fitting tube 12 including the bridge 33 can be maintained in a tubular shape and the fitting tube 12 and the mating housing 200 can be connected smoothly.

The entering portions 58 of the projecting pieces 53 contact the inner sides of the opposite ends of the bridge 33 before the detector 50 reaches the detection position, and the contact portion 57 is stopped in contact with the bridge 33 when the detector 50 reaches the detection position. Thus, the bridge 33 will not be deformed by an impact when the contact portion 57 is stopped in contact.

The curved wall 99 is arranged more outward than the rattling preventing portion 45 when the front member 90 is viewed from the front. Thus, foreign matter cannot contact the rattling preventing portion 45 from outside. As a result, a projecting shape of the rattling preventing portion 45 is maintained and the reliability of rattling prevention by the rattling preventing portion 45 can be enhanced.

The curved wall 99 has both a function of protecting the rattling preventing portion 45 and a function of regulating detachment of the seal 70. Thus, the entire configuration of the front member 90 becomes complicated.

The rattling preventing portion 45 overlaps the outermost end portion 42 of the curved wall 99 in the height direction when viewed from the front. Thus, foreign matter is less likely to interfere with the rattling preventing portion 45 from outside.

Other embodiments are briefly described below.

Figure 21:
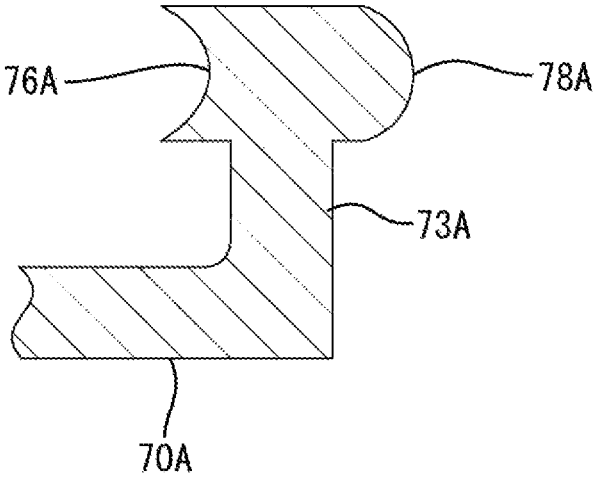
FIG. 21 is a schematic enlarged section of a protruding piece in another embodiment.

As shown in FIG. 21, a protruding piece 73A of a seal 70A is provided with a pressure receiving portion 76A in the form of a concave surface on the front and a protrusion 78A in the form of a convex surface on the rear. When the two housings 10, 200 are connected, the opening end of the receptacle 210 may be fit in a positioned state into the pressure receiving portion 76A and the protrusion 78A may be fit in a positioned state into the recess 36 of the coupling 13.

The front member may be configured as a front mask not having a retainer function.

The curved surfaces may be formed only on the opening end parts of the recesses.

Also when the detector is located at the standby position or regardless of which of the standby position and the detection position the detector is located at, the projecting pieces may be arranged to contact the inner sides of the opposite end parts of the bridge.

LIST OF REFERENCE SIGNS

10 . . . housing
11 . . . housing main body
12 . . . fitting portion
13 . . . coupling portion
14 . . . connection space
15 . . . cavity
16 . . . locking lance
17 . . . lock arm
29 . . . open space portion
33 . . . bridge portion
36 . . . recess
37 . . . curved surface portion
41 . . . straight wall
42 . . . outermost end portion
43 . . . pressing portion
45 . . . rattling preventing portion
50 . . . detecting member
52 . . . detection arm
53 . . . projecting piece
57 . . . contact portion
58 . . . entering portion
70, 70A . . . seal
71 . . . seal main body
72 . . . strip piece
73, 73A . . . protruding piece
78, 78A . . . protrusion
90 . . . front member
99 . . . curved wall
200 . . . mating housing
210 . . . receptacle
214 . . . erroneous connection preventing surface

What is claimed is:

1. A connector, comprising:

a first housing having a housing main body;

a mating housing having a receptacle to be fit externally to the housing main body from a front and along a connecting direction, the mating housing having an erroneous connecting preventing surface extending parallel to the connecting direction;

a seal to be fitted on an outer peripheral surface of the housing main body and resiliently sandwiched between the housing main body and the receptacle when the first housing and the mating housing are connected; and a front member to be mounted on a front surface side of the housing main body and arranged inside the mating housing when the two housings are connected, the front member including a front wall and a peripheral wall extending rearward from the front wall, the peripheral wall having a straight wall extending parallel to the connecting direction and configured to face the erroneous connection preventing surface of the mating housing when the housing is in a proper connection posture with respect to the mating housing, and a rattling preventing portion provided to project on the straight wall and configured to contact an inner surface of the receptacle to suppress rattling between the two housings, and a curved wall having opposed first and second ends coupled to the straight wall so that the curved wall is arranged more outwardly than the rattling preventing portion when viewed from front and configured to regulate forward detachment of the seal with the front member mounted on the housing main body.

2. The connector of claim 1, wherein the rattling preventing portion is arranged at a position overlapping with an outermost end portion of the curved wall in a height direction when viewed from front.

* * * * *